US011131966B2

(12) United States Patent
Sayers et al.

(10) Patent No.: US 11,131,966 B2
(45) Date of Patent: Sep. 28, 2021

(54) TEMPORAL CALENDAR TIMEPIECE

(71) Applicant: Hewlett-Packard Development Company, L.P., Houston, TX (US)

(72) Inventors: Craig Peter Sayers, Menlo Park, CA (US); Ralph A. Morales, III, Mira Mesa, CA (US); Terrance J. O'Shea, Vancouver, WA (US); Thomas E. Pearson, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 587 days.

(21) Appl. No.: 16/072,255

(22) PCT Filed: Apr. 29, 2016

(86) PCT No.: PCT/US2016/030222
§ 371 (c)(1),
(2) Date: Jul. 24, 2018

(87) PCT Pub. No.: WO2017/189004
PCT Pub. Date: Nov. 2, 2017

(65) Prior Publication Data

US 2019/0033785 A1 Jan. 31, 2019

(51) Int. Cl.

| | |
|---|---|
| ***G04B 19/20*** | (2006.01) |
| ***G04B 19/24*** | (2006.01) |
| ***G04G 21/04*** | (2013.01) |
| ***G04C 17/00*** | (2006.01) |

(52) U.S. Cl.
CPC ..... *G04B 19/24* (2013.01); *G04B 19/20* (2013.01); *G04B 19/202* (2013.01); *G04C 17/00* (2013.01); *G04C 17/005* (2013.01); *G04G 21/04* (2013.01)

(58) Field of Classification Search
CPC ..... G04G 19/24; G04G 21/04; G04C 17/005; G04C 17/00; G04B 19/202; G04B 19/20
See application file for complete search history.

(56) References Cited

U.S. PATENT DOCUMENTS

| | | | | |
|---|---|---|---|---|
| 4,632,569 | A * | 12/1986 | Gogniat | G04B 19/241 368/35 |
| 6,259,655 | B1 | 7/2001 | Witort | |
| 6,735,151 | B2 * | 5/2004 | Triponez | G04B 19/20 368/28 |
| 7,027,360 | B2 * | 4/2006 | Kitahara | G04C 17/0066 368/28 |
| 7,420,880 | B2 * | 9/2008 | Burkhardt | G04C 17/0058 368/28 |

(Continued)

OTHER PUBLICATIONS

Pebble Time Round Review; Nov. 25, 2015 ; http://www.ctrlhelp.com/pebble-time-round-review.html.

(Continued)

*Primary Examiner* — Sean Kayes
(74) *Attorney, Agent, or Firm* — Dicke Billing & Czaja PLLC

(57) ABSTRACT

A timepiece includes at least one time-of-day hand rotatable relative to a first dial and a first pair of temporal calendar mechanical elements independently rotatable relative to each other, and relative to the at least one time-of-day hand. Controlled rotation of the respective temporal calendar mechanical elements is synchronizable relative to temporal calendar information on an external device.

14 Claims, 11 Drawing Sheets

(56) References Cited

U.S. PATENT DOCUMENTS

| | | | | |
|---|---|---|---|---|
| 8,830,797 | B2 * | 9/2014 | Dubugnon | G04B 19/24 368/37 |
| 2002/0024887 | A1 * | 2/2002 | Triponez | G04C 17/0066 368/35 |
| 2003/0007420 | A1 | 1/2003 | Shteyn | |
| 2004/0264303 | A1 | 12/2004 | Brida et al. | |
| 2006/0062089 | A1 | 3/2006 | Lizzi | |
| 2010/0162170 | A1 * | 6/2010 | Johns | G04G 21/00 715/834 |
| 2012/0127835 | A1 * | 5/2012 | Dubugnon | G04B 19/25353 368/37 |
| 2013/0303087 | A1 | 11/2013 | Hauser et al. | |
| 2014/0293755 | A1 | 10/2014 | Geiser et al. | |
| 2015/0105125 | A1 | 4/2015 | Min et al. | |
| 2015/0131412 | A1 | 5/2015 | Springer | |
| 2016/0085216 | A1 | 3/2016 | Wang et al. | |
| 2016/0306442 | A1 * | 10/2016 | Lee | G06F 3/04847 |
| 2016/0320756 | A1 * | 11/2016 | Lee | G06F 3/03547 |

OTHER PUBLICATIONS

Pujie Black Watch Face; https://play.google.com/store/apps/details?id=com.pujie.wristwear.pujieblack&hl=en.

* cited by examiner

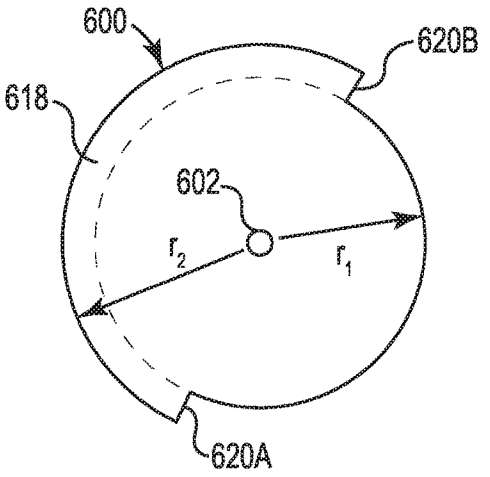
Fig. 8A
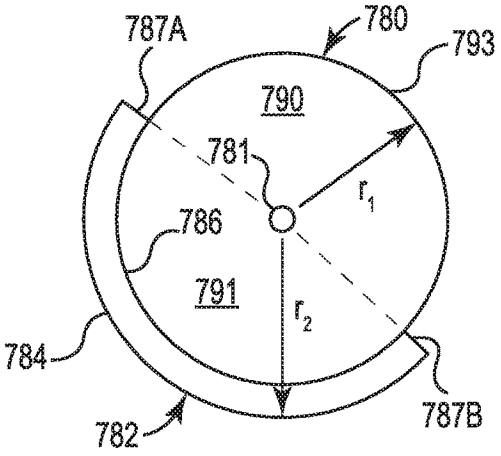
Fig. 8B
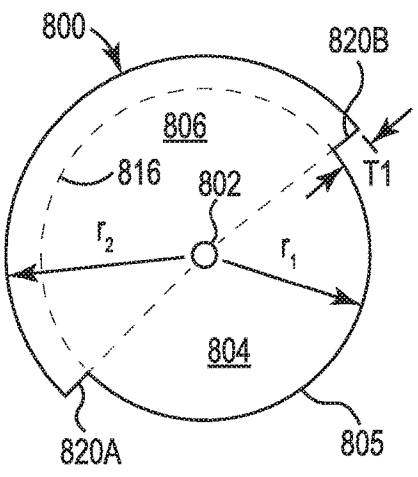
Fig. 8C
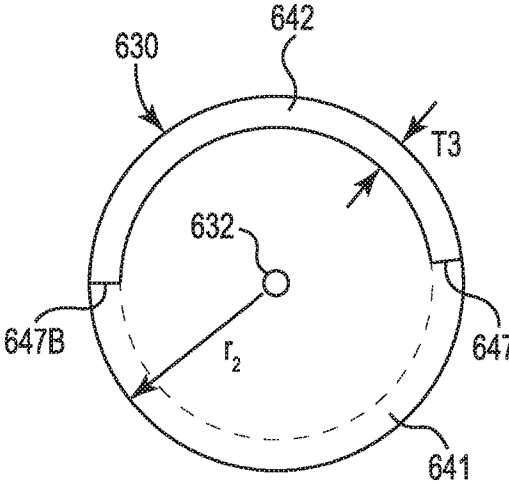
Fig. 8E
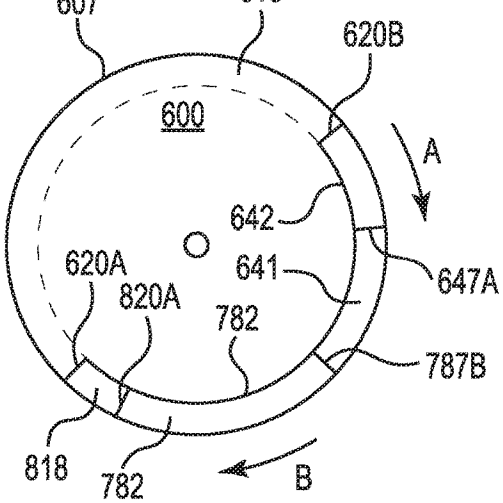
Fig. 8F
Fig. 8D

TEMPORAL CALENDAR TIMEPIECE

BACKGROUND

Time keeping devices are seemingly omnipresent in modern life. They are present in cars, homes, offices, worn on the body, etc. In one form, a time keeping device comprises a timepiece, such as a watch or clock.

BRIEF DESCRIPTION OF THE DRAWINGS

FIGS. 8A-8D are each a top view schematically representing temporal calendar mechanical elements of a timepiece, according to one example of the present disclosure.

FIG. 8E is an exploded view schematically representing temporal calendar mechanical elements, according to one example of the present disclosure.

FIG. 8F is a top view schematically representing some aspects of interaction of temporal calendar mechanical elements, according to one example of the present disclosure.

DETAILED DESCRIPTION

Figure 1A:
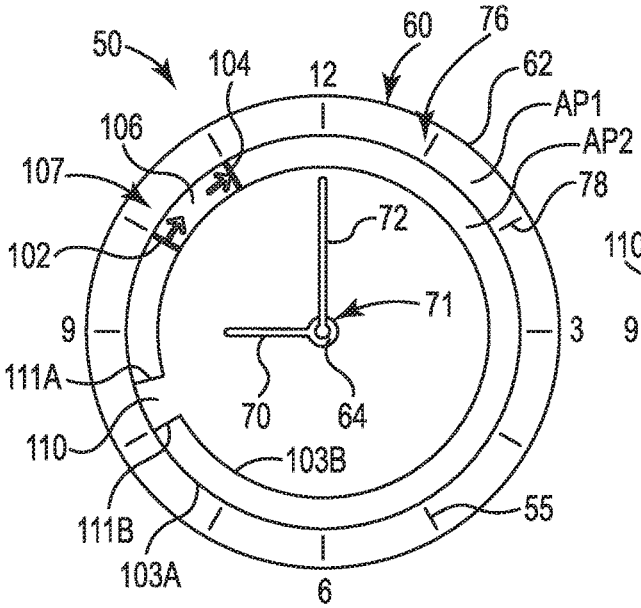
FIGS. 1A-1D are each a top view schematically representing a timepiece at different points in time, according to one example of the present disclosure.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense. It is to be understood that features of the various examples described herein may be combined, in part or whole, with each other, unless specifically noted otherwise.

At least some examples of the present disclosure are directed at displaying temporal calendar information with timekeeping information on a timepiece, such as a watch or clock. In some examples, the timekeeping information is displayed via analog elements, such as mechanical hands or arms which rotate about a center or mechanical elements which follow a circular track to keep time.

Via such arrangements, a user may observe and manage temporal calendar information via a timepiece instead of having to take the time and hassle to manipulate another device (e.g. a mobile phone, tablet, notebook computer, desktop computer etc.) to observe and manage such temporal calendar information. For example, the user may look at their timepiece to quickly determine what time a next event starts or ends, its duration, as well as determining the amount of time between two separate events, etc. This arrangement is less disruptive and allows the user to perform time management functions more discreetly when in a meeting or other public situation.

In addition, providing such temporal calendar information on a timepiece via mechanical elements instead of a digital display may save power to promote longer battery life. In some examples, use of the mechanical elements to display temporal calendar information provides a display with better contrast than a digital display, thereby being easier on the eyes. Such displays also can be more attractive.

In some instances, the appearance and operation of the temporal calendar mechanical elements may be referred to as an analog display in at least the sense that the display is non-digital and/or provides observable movement of the calendar mechanical elements to convey the temporal calendar information.

In some examples, the temporal calendar information may include information about events, such as a start time, end time, and duration of the event.

In some examples, an event corresponds to a period of time extending between a fixed start time and a fixed end time, regardless of the content or activity occurring during the event. In practical terms, an event can be a meeting, an appointment, scheduled time for a task, etc.

In some examples, an event can correspond to a period of time extending between a start time and an end time with the start time being adjustable and/or the end time being adjustable. In some examples, the adjustment of the start time and/or end time is made prior to initiation of the event. In some examples, a basis for the adjustment is a variable parameter and not a fixed time value. However, in some examples, the adjustment can be made after initiation of the event via adjusting the end time according to a discrete time value or according to a variable parameter. Adjustments to the start time and/or the end time are further described later in association with at least FIG. 5.

Other aspects regarding such display and management of temporal calendar information are described later.

One example arrangement in a timepiece suitable to implement display and management of temporal calendar information simultaneous with timekeeping functions is described below. The timepiece includes a time-of-day hand rotatable relative to a first dial and a first pair of temporal calendar mechanical elements independently rotatable relative to each other to exhibit temporal calendar information. Controlled rotation of the respective temporal calendar mechanical elements is electromechanically independent of the at least one time-of-day hand and is synchronizable relative to temporal calendar information on an external device.

Many additional example arrangements are described later throughout examples of the present disclosure.

These examples, and additional examples, are described and illustrated in association with at least FIGS. 1-13.

FIGS. 1A-1D are each a top view schematically representing a timepiece 50 at different points in time, according to one example of the present disclosure. As shown in FIG. 1A, timepiece 50 includes a first dial 60 defining a first annular path (AP1) defined between an outer edge 62 and an inner edge 63, with an array 76 of markings 78 spaced apart from each other. Each marking 78 represents an hour (e.g. 12, 1, 2, 3, etc.) as typically found on a timepiece.

The timepiece 50 also comprises a timekeeping unit 71, which includes an hour hand 70 and a minute hand 72, both of which rotate relative to a center 64 of dial 60 (and of the timepiece 50).

As further shown in FIG. 1A, nested concentrically relative to dial 60 (and first annular path AP1) is a second annular path AP2 having an outer edge 103A and an inner edge 103B. It will be understood the outer edge 103A and inner edge 103B which define second annular path AP2 may themselves defined by the relationship and/or juxtaposition of different mechanical components, with at least some of those components being described later in association with at least FIG. 2.

Timepiece 50 also comprises an array 107 of several mechanical elements, which together provide information regarding an event. As shown, information regarding an event can be represented via an event start indicator 102 and an event end indicator 104, with the space between the respective indicators 102 and 104 representing a duration 106 of the event. While both of the indicators 102, 104 are depicted as symbols including arrows, it will be understood that other types of symbols may be used provided that the two symbols are visibly different in at least one recognizable aspect so one can distinguish the start time from the end time of the event.

In some examples, an event corresponds to a period of time extending between a fixed start time and a fixed end time, regardless of the content or activity occurring during the event. In practical terms, an event can be a meeting, an appointment, scheduled time for a task, etc.

In some examples, an event can correspond to a period of time extending between a start time and an end time with the start time being adjustable and/or the end time being adjustable. In some examples, the adjustment of the start time and/or end time is made prior to initiation of the event. In some examples, a basis for the adjustment is a variable parameter and not a fixed time value. However, in some examples, the adjustment can be made after initiation of the event via adjusting the end time according to a discrete time value or according to a variable parameter. Adjustments to the start time and/or the end time are further described later in association with at least FIG. 5.

Details regarding the setting of the position and/or movement of the indicators 102, 104 are described further in association with at least FIGS. 1A-1D after general introduction of the timepiece in association with FIG. 1A.

As shown in FIG. 1A, timepiece 50 also comprises a tab 110 which acts as a cover under which the start indicator 102 and/or indicator 104 may be selectively, temporarily hidden, as further described and illustrated later in association with at least FIGS. 1B-1D. In some instances, this behavior may indicate that there is no event scheduled to start in the next 11 hours, such as when tab 110 covers start indicator 102. In some instances, this covering behavior indicates other information.

In some examples, the tab 110 holds a fixed position relative to the hour hand 70 as shown in FIG. 1A. Accordingly, as hour hand 70 moves to keep time, the tab 110 moves simultaneously with hour hand 70 while maintaining its fixed position relative to hour hand 70. In the particular moment in time shown in FIG. 1A, with the hour hand pointing to the 9 o'clock position, a front edge 111A of tab 110 is in a position corresponding to about 8:30 and the back edge 111B of tab 110 in a position corresponding to about 8:00 such that tab 110 spans an arc length (e.g. 30 degrees) corresponding to about one half hour. In this way, the time not covered by the tab 110 extends from 30 minutes in the past to 11 hours into the future, corresponding to the duration of time for which the start and end times for events can be shown. Accordingly, the tab 110 may sometimes be referred to as an hour follower tab.

It will be understood that, in some examples tab 110 can have a shorter or longer arc length and may lag the hour hand 70 by a shorter or longer time. However, even with any of these variations, the tab 110 will remain large enough so that the start indicator 102 and end indicator 104 can be hidden under the tab 110.

With these aspects in mind, as shown in FIG. 1A the hands 70, 72 of timepiece 50 indicate a time of 9 o'clock, while the start indicator 102 and end indicator 104 communicate an event beginning at 10 o'clock and having a duration 106 of one hour, i.e. ending at 11 o'clock.

Figure 1B:
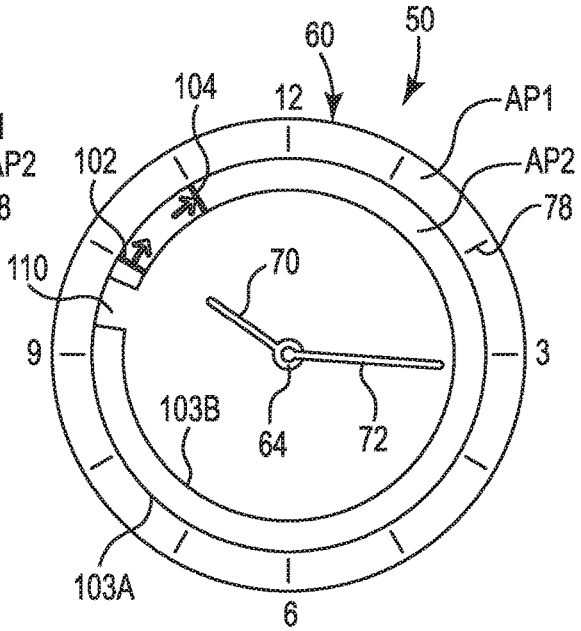

FIG. 1B represents a later point in time, such as about 10:15, as represented via hands 70, 72 with tab 110 having moved (while maintaining the same position relative to hand 70) and with the respective indicators 102, 104 remaining at their fixed locations. At this point, the event would be in progress since the hour hand is between the start 102 and end 104 indicators.

Figure 1C:
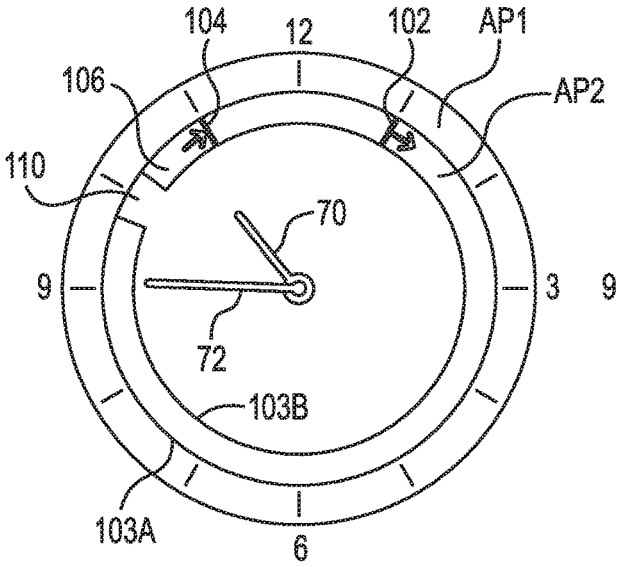

FIG. 1C represents a later point in time, such as 10:45, as indicated via hands 70, 72. The end indicator 104 remains unchanged to show the current event is still expected to finish at 11:00. The start indicator 102 has been advanced to a new position, e.g. at 1 o'clock to identify the start time of the next event. Accordingly, the user may take note of the first event being substantially under way or nearing completion, and they can also observe the start time of the next event.

Figure 1D:
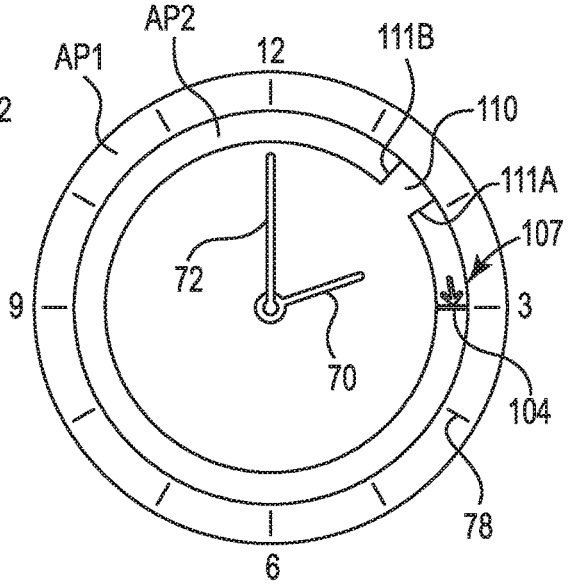

FIG. 1D represents an even later point in time, such as 2 o'clock, as represented via hands 70, 72. End indicator 104 remains visible at its 3 o'clock position to indicate the end time of the on-going event. However, because no further events are scheduled for the next 11 hours, the start indicator 102 is moved to remain hidden underneath tab 110. When the time is 3:30, it is well past the end time for the event, so if no further events are scheduled in the next 11 hours then both the start indicator 102 and end indicator 104 will be moved so as to remain hidden under the tab 110. Accordingly, the user may take note that the previous event should have ended and that there is no event scheduled for the next 11 hours.

Because the tab 110 will continue to travel in synchrony with the hour hand 70, in this situation both the start indicator 102 and the end indicator 104 will travel in their hidden position, with tab 110, to remain covered.

Figure 2:
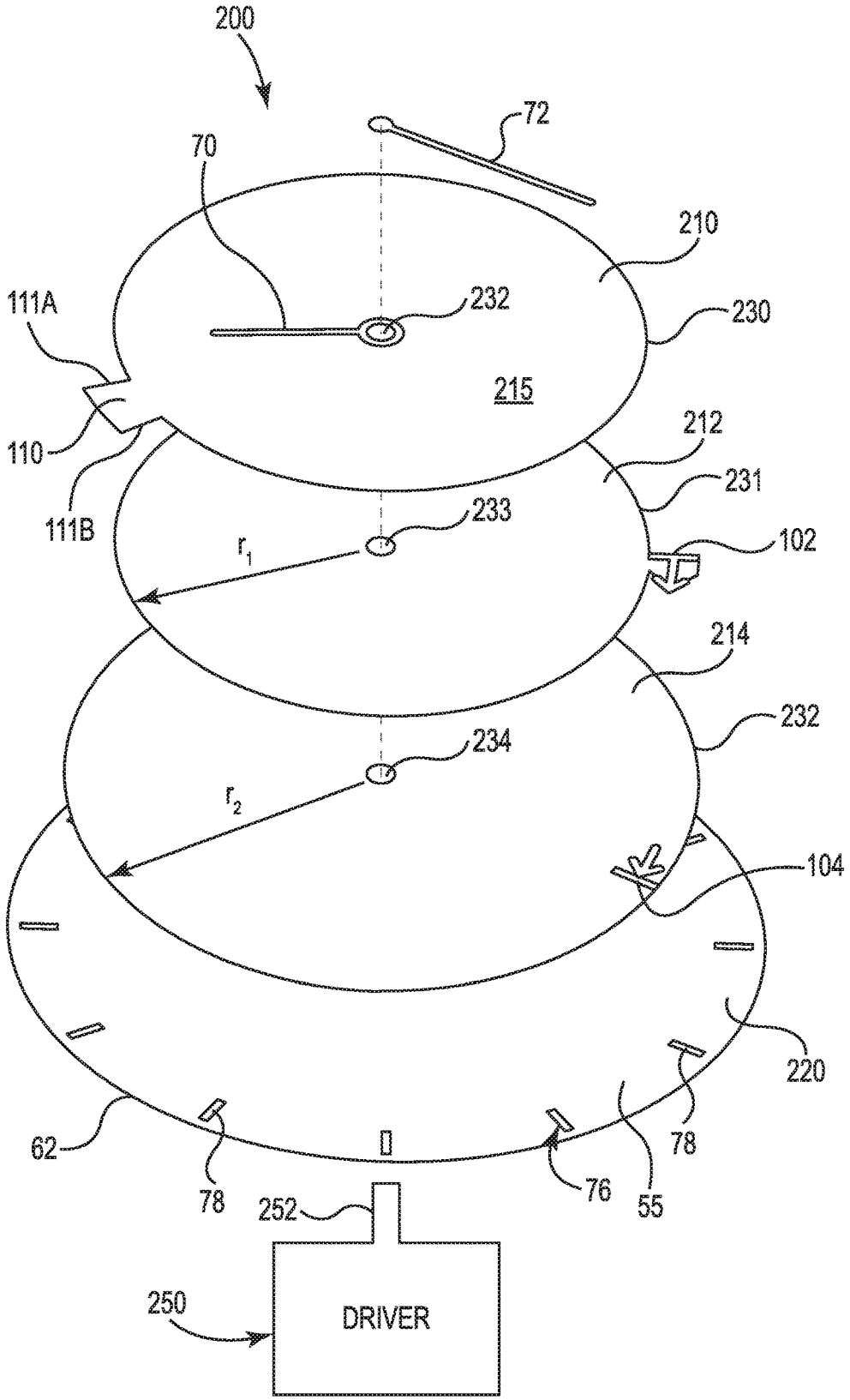
FIG. 2 is an exploded view schematically representing a timepiece assembly, according to one example of the present disclosure.

FIG. 2 is an exploded view schematically representing a timepiece assembly 200, according to one example of the present disclosure. In some examples, timepiece assembly 200 represents one example implementation of the timepiece 50, and in some examples, timepiece assembly 200 comprises at least some of substantially the same features and attributes of timepiece 50. Accordingly, in FIG. 2, like reference numerals in FIG. 2 represent like elements in FIGS. 1A-1D.

As shown in FIG. 2, timepiece assembly 200 comprises minute hand 72 and hour hand 70. In some examples, timepiece assembly 200 comprises an array 202 of discs 210, 212, 214, 220 arranged in a vertically stacked relationship with disc 210 on top of the stack. In some examples, hour hand 70 is not a freestanding element but rather is defined by a marking formed on, or element fixed onto, a top surface 215 of disc 210. Accordingly, rotation of hour hand 70 to keep time is dictated by rotation of disc 210.

In some examples, disc 210 includes an outer edge 230, which corresponds to the inner edge 103B of annular path AP2 in FIGS. 1A-1D. In addition, disc 210 includes a protrusion (e.g. tab) corresponding to, and defining, the tab 110.

It will be understood that, in some examples, disc 210 omits a mark for hour hand 70, and instead, timepiece 50 includes an hour hand formed of an element that moves freely and independently from disc 210. However, in this instance, movement of disc 210 is controlled relative to movement of hour hand 70 such that the tab 110 will maintain a preset fixed distance (e.g. position) relative to hour hand 70.

In some examples, instead of disc 210, timepiece 50 comprises a narrow elongate member (e.g. a stem) including at an outer portion defining tab 110, with the stem having a length sufficient for tab 110 to connect to a conventional hour hand, allowing tab 110 to travel along annular path AP2 (FIG. 1A).

In some examples, as further shown in FIG. 2, disc 212 is provided to define and support start indicator 102. Disc 212 includes a center 233 and an outer edge 231, which corresponds to the inner edge 1036 of annular path AP2 in FIGS. 1A-1D. In at least this example, start indicator 102 comprises a protrusion extending outward from the outer edge 231. The start indicator 102 can have any one of a wide variety of shapes and generally includes a symbol, marking, or other conspicuous indicia suitable to indicate a start of an event.

Disc 212 has a radius r1, which is the same as a radius of disc 210 and which is less than a radius r2 of disc 214 below disc 212. The difference in the radius r1 of disc 212 and the radius r2 of disc 214 corresponds to a radial thickness (T1) of the annular path AP2 in FIG. 1A.

In some examples, as further shown in FIG. 2, disc 214 is provided to define and support end indicator 104. Disc 214 includes a center 234 and an outer edge 232, which corresponds to the outer edge 103A of annular path AP2 in FIGS. 1A-1D. End indicator 104 comprises a symbol, marking, or other conspicuous indicia formed near, but within outer edge 232. The end indicator 104 can have any one of a wide variety of shapes and generally includes a symbol suitable to indicate a start of an event.

Disc 214 has a radius r2, which is less than a radius of disc 220 below disc 214. The difference in the radius r2 of disc 214 and the radius of disc 220 corresponds to a radial thickness of the annular path AP1 in FIG. 1A which bears hourly time markings 78 on dial 60. The discs 212 and 214 serve to hold start indicator 102, and end indicator 104, respectively, so that they can all rotate about the same axis as the tab 110. In some examples, the colors of the three discs and tab 110 may all be similar to disc 220 so that they are largely invisible, allowing the hands (70,72) and indicators (102,104) to have prominence along with the hourly markings on disc 220. It should be apparent that while the supporting structures for hand 70, tab 110, and indicators 102,104 are shown as discs, in some examples other alternative physical embodiments could support the same relative motions of indicators 102, 104, and tab 110. It should further be apparent that, in some examples additional start and end indicators could be added by adding additional discs, allowing more than one event start or end time to be shown simultaneously.

In some examples, as shown in FIG. 2, timepiece assembly 200 comprises a driver 250 having a shaft assembly 252 coupled to a center of each of the respective discs 210, 212, 214, 220 and hand 72 to electromechanically drive and control a rotational movement of each the respective discs 210, 212, 214, 220 and hand 72. At least some details regarding shaft assembly 252 and drive 250 are described further in association with at least FIGS. 3 and 5.

Figure 3B:
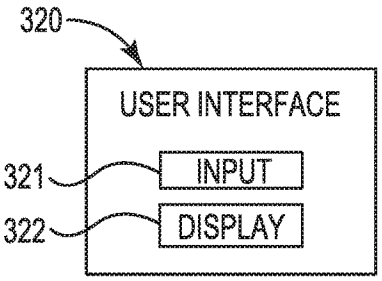
FIG. 3B is a block diagram schematically representing a user interface, according to one example of the present disclosure.
Figure 3A:
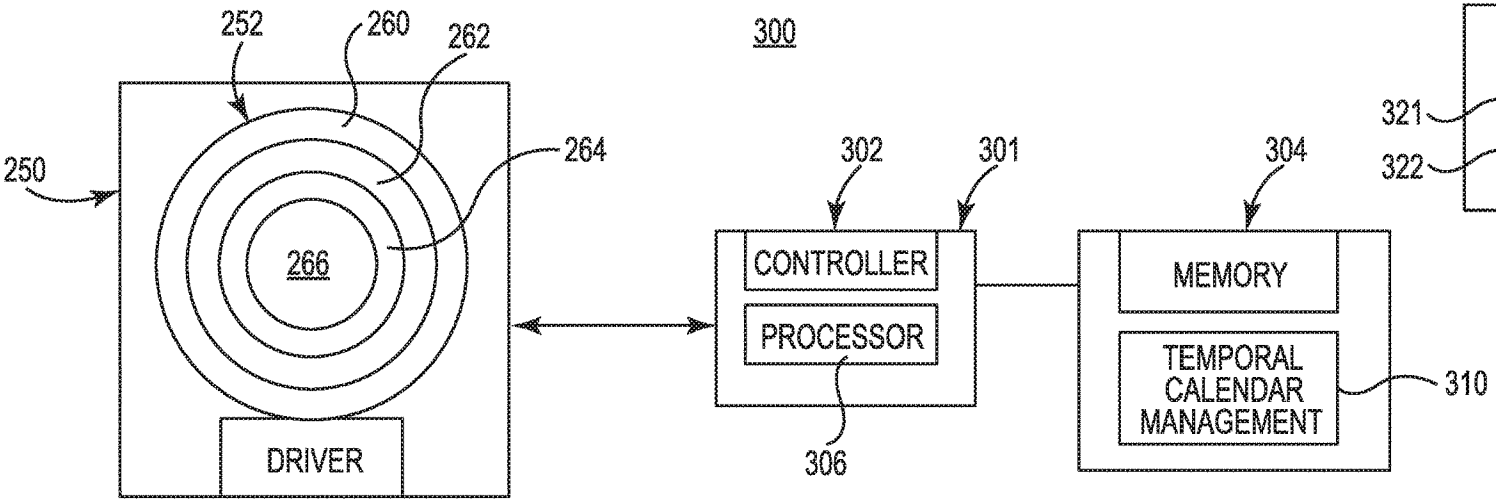
FIG. 3A is block diagram schematically representing a control system, according to one example of the present disclosure.

FIG. 3A is block diagram schematically representing a control system 300, according to one example of the present disclosure. As shown in FIG. 3A, in some examples driver 250 includes the shaft assembly 252, which includes an array of at least the concentrically arranged annular shaft portions 260, 262, 264, and center shaft portion 266. Via driver 250, the respective annular shaft portions 260, 262, 265 and center shaft portion 266 are driven electromechanically independent of one another. Each respective shaft portion 260, 262, 264 is coupled to a respective disc 210, 212, 214 while central shaft portion 266 is coupled to minute hand 72. Via this arrangement, driver 250 drives and controls rotational movement of discs 210, 212, 214 and minute hand 72, which thereby results in controllable rotational movement of tab 110, start indicator 102, end indicator 104, and minute hand 72 to indicate temporal calendar information, such as information regarding an event.

In some examples, as shown in FIG. 3A, driver 250 forms the control system 300, which includes a control portion 301.

In some examples, control portion 301 includes a controller 302 and a memory 304, which stores temporal calendar management engine 310. One example implementation of temporal calendar management engine 310 is described later as engine 400 in association with at least FIG. 5.

Controller 302 of control portion 301 can comprise at least one processor 306 and associated memories that are in communication with memory 304 to generate control signals, and/or provide storage, to direct operation of at least some components of the timepieces, timepiece assemblies, drivers, devices, systems, components, engines, functions, and/or parameters described throughout the present disclosure. In some examples, these generated control signals include, but are not limited to, employing driver 250 and/or management engine 310 to implement temporal calendar information on a timepiece and associated elements and activities described in at least some examples of the present disclosure as described in association with at least FIGS. 1-13.

In response to or based upon commands received via a user interface 320 (FIG. 3B) and/or via machine readable instructions, controller 302 generates control signals to implement at least timing and sequence of the operation of the various aspects of a device for, or a method of, managing temporal calendar information on a timepiece in accordance with at least some examples of the present disclosure. In some examples, controller 302 is embodied in a general purpose computer while in other examples, controller 302 is embodied in an driver 250 described herein generally, or incorporated into or associated with at least some of the components described throughout the present disclosure, such as but not limited to temporal calendar management engine 310 in FIG. 3 and engine 400 in FIG. 5. In some examples, controller 302 comprises a server computer.

For purposes of this application, in reference to the controller 302, the term processor shall mean a presently developed or future developed processor (or processing resource) that executes sequences of machine readable instructions contained in a memory. In some examples, execution of the sequences of machine readable instructions, such as those provided via memory 304 associable with control portion 301 to cause the processor to perform actions, such as operating controller 302 to implement display and synchronization of temporal calendar information and/or other related functions, as generally described in (or consistent with) at least some examples of the present disclosure. The machine readable instructions may be loaded in a random access memory (RAM) for execution by the processor from their stored location in a read only memory (ROM), a mass storage device, or some other persistent storage, as represented by memory 304. In some examples, memory 304 comprises a volatile memory. In some examples, memory 304 comprises a non-volatile memory. In some examples, memory 304 comprises a computer readable tangible medium providing non-transitory storage of the machine readable instructions executable by a process of controller 302. In other examples, hard wired circuitry may be used in place of or in combination with machine readable instructions to implement the functions described. For example, controller 302 may be embodied as part of at least one application-specific integrated circuit (ASIC). In at least some examples, the controller 802 is not limited to any specific combination of hardware circuitry and machine readable instructions, nor limited to any particular source for the machine readable instructions executed by the controller 302.

In some examples, user interface 320 shown in FIG. 3B provides for the simultaneous display, activation, and/or operation of at least some aspects of the various timepieces, timepiece assemblies, drivers, devices, methods, components, engines, functions, parameters, features, and attributes of driver 250, temporal calendar management engine 310 (FIG. 3), temporal calendar management engine 400 (FIG. 5), and/or control portion 301 and/or of at least the various aspects of managing temporal calendar information on a timepiece, as described throughout the present disclosure.

In some examples, at least some portions or aspects of the user interface 320 are provided via a graphical user interface (GUI). As shown in FIG. 3B, in some examples user interface 320 includes an input 321 and a display 322, which may or may not be combined in a single element, such as a touch screen display. In some examples, user interface 320 is provided via a desktop computer, a terminal associated with a server, a laptop computer, a tablet, phablet, mobile phone, smart watch, and the like.

Figure 4B:
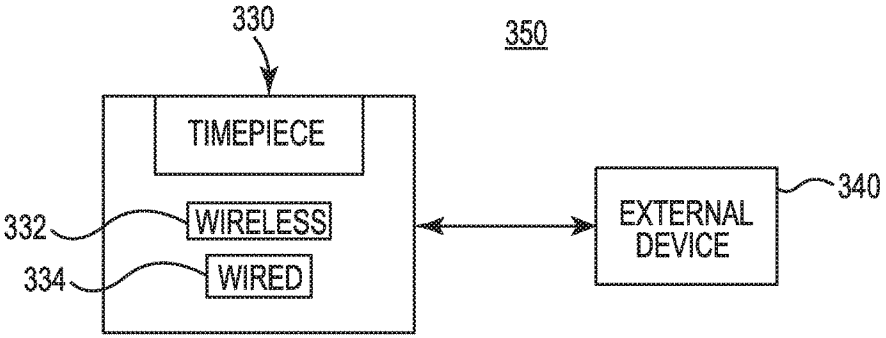
FIG. 4B is a block diagram schematically representing communication between a timepiece and an external device, according to one example of the present disclosure.
Figure 4A:
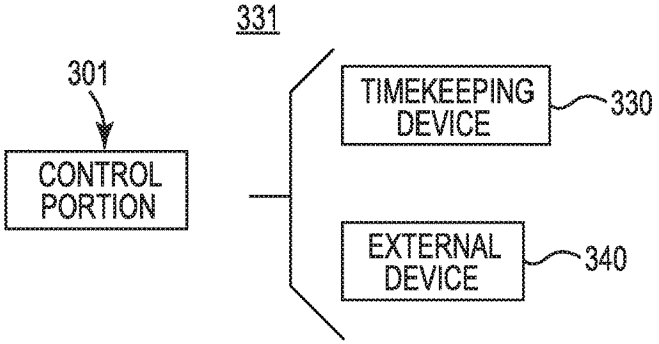
FIG. 4A is a block diagram schematically representing at least some aspects of a control portion, according to one example of the present disclosure.

FIG. 4A is a block diagram 331 schematically representing at least some aspects of a control portion 301, according to one example of the present disclosure. As shown in FIG. 4A, the control portion 301 can be embodied in timepiece 330 and/or an external device 340, with the timepiece 330 comprises at least some of substantially the same features and attributes as timepiece 50 (FIGS. 1A-1D) and/or timepiece assembly 200 in FIG. 2.

FIG. 4B is a block diagram 350 schematically representing communication between a timepiece and an external device, according to one example of the present disclosure. As shown in FIG. 4B, timepiece 330 includes a wireless communication tool 332 and/or a wired communication tool 334, either of which enable communicative coupling with corresponding communication tools within an external device 340. In this way, temporal calendar information can be shared between timepiece 330 and external device 340, and implementation of control portion 301 can be realized among timepiece 330 and external device 340. In some examples, the example timepiece 330 in FIG. 4B comprises at least some of substantially the same features and attributes as timepiece 50 (FIGS. 1A-1D), timepiece assembly 200 in FIG. 2, and/or timepiece 330 in FIG. 4A.

Figure 5:
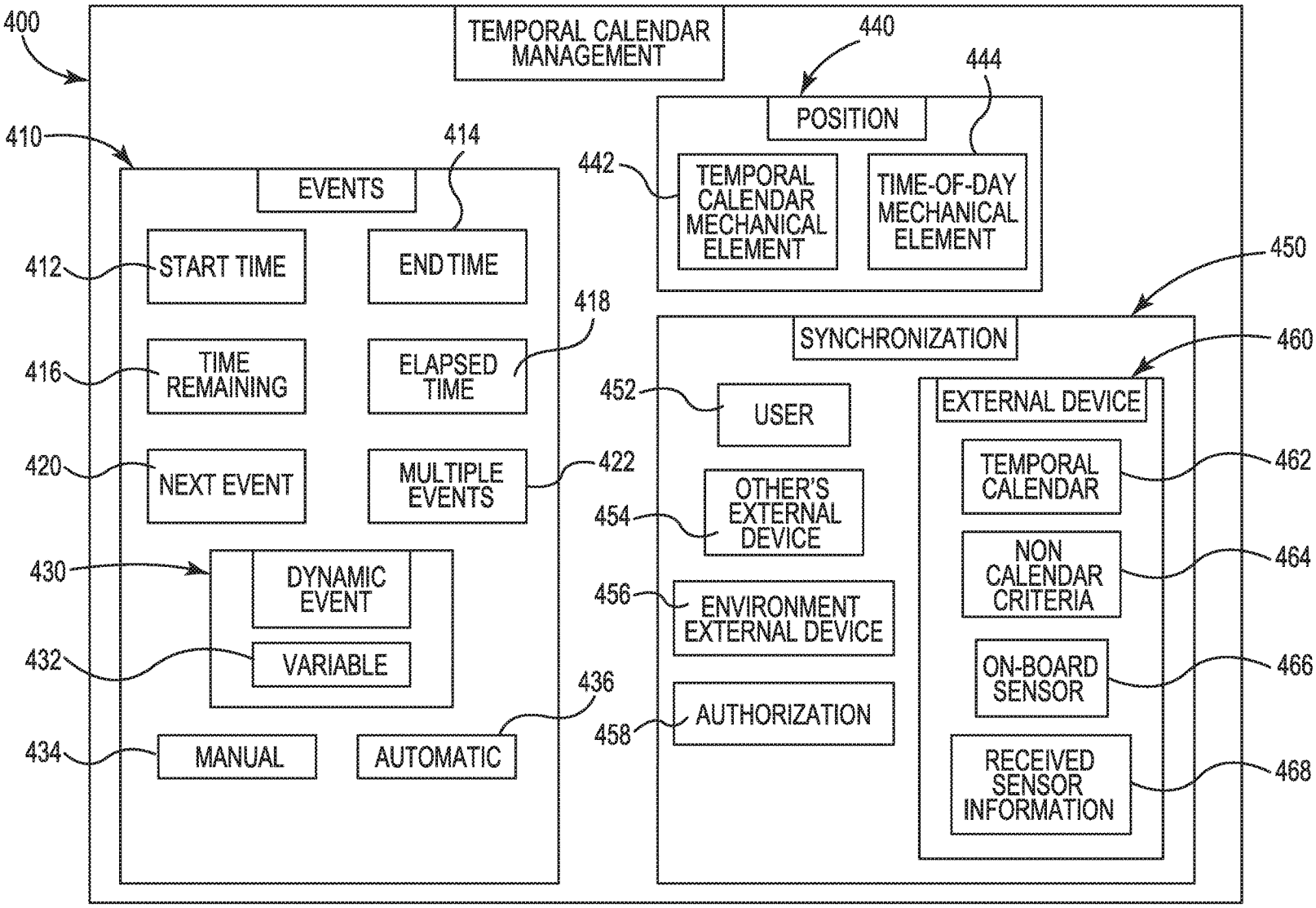
FIG. 5 is a block diagram schematically representing a temporal calendar management engine, according to one example of the present disclosure.

FIG. 5 is a block diagram schematically representing a temporal calendar management engine 400, according to one example of the present disclosure. In some examples, temporal calendar management engine 400 comprises one implementation of the temporal calendar management engine 310 stored in memory 304 in control portion 301 in FIG. 3A and/or comprises at least some of substantially the same features and attributes as temporal calendar management engine 310 in FIG. 3A.

In general terms, temporal calendar management engine 400 manages temporal calendar information (such as events) as displayable on a timepiece.

As shown in FIG. 5, temporal calendar management engine 400 comprises an events control engine 410 to manage display of events on a timepiece (e.g. 50 in FIGS. 1A-1D). In some examples, events control engine 410 comprises a start time parameter 412 to indicate a start time of an event and an end time parameter 414 to indicate an end time of the event. For an event in progress, a time remaining parameter 416 indicates the amount of time remaining to complete the event while a time elapsed parameter 418 indicates the amount of time elapsed in the event. Next event parameter 420 identifies the existence of a next event, as well as its start time and end time. Multiple events parameter 422 identifies the existence of multiple events, the start time and end time of each event, and the time between successive events.

Dynamic event parameter 430 implements events for display on a timepiece in which some aspect of the event is dynamic, such as having an adjustable start time, an adjustable end time, and/or an adjustable based on a variable per variable parameter 432. The event is considered dynamic in the sense that the end time may be adjusted after the event has started or in the sense that a previously set start time is automatically adjusted in response to the variable parameter 432. At least some examples of information by which the variable parameter 432 may be implemented is further described later in association with at least synchronization engine 450 in FIG. 5.

A manual parameter 434 enables a user to manually implement temporal calendar information (e.g. calendar day start, end, duration) for display on a timepiece while automatic parameter 436 enable automatic implementation of temporal calendar information on a timepiece. For instance, recurring events (e.g. a daily meeting, weekly meeting, etc.) can be automatically implemented as temporal calendar information on a timepiece.

As shown in FIG. 5, temporal calendar management engine 400 comprises a position control engine 440. In some examples, per parameter 442 the position control engine 440 implements the controlled position of temporal calendar mechanical elements of a timepiece, such as any one of the discs 210, 212, 214 supporting the tab 110, start indicator 102 and end indicator 104, respectively. In some examples, per parameter 444 the position control engine 440 implements the controlled position of time-of-day mechanical elements, such as minute hand 72 and in some examples, also hour hand 74 such as when hour hand 74 is implemented separately from disc 210.

As shown in FIG. 5, temporal calendar management engine 400 comprises a synchronization engine 450 to manage synchronization of a timepiece (e.g. 50 in FIGS. 1A-1D) relative to an external device (e.g. 340 in FIGS. 4A-4B). In some examples, a user wears or possesses both the timepiece and the external device. The synchronization engine 450 can include a user external device function 452 to manage synchronization of temporal calendar information between a user's external device and their timepiece. Meanwhile, in some examples the other's external device function 454 is provided to manage synchronization with temporal calendar information on another person's external device, such as a child, colleague, friend, etc. Via an authorization function 458, a user can determine who and/or which external devices are authorized to be synchronized relative to timepiece 50 and/or their external device.

In some examples, the synchronization engine 450 can include an environment external device function 456 to manage synchronization with temporal calendar information on an environmental external device, such as a weather station, traffic reporting feed, etc. which may be available for wireless communication with timepiece 50 (and/or an associated external device) to enable adjustments to an event per variable parameter 432 of dynamic event function 430.

In some examples, synchronization engine 450 comprises an external device engine 460 to manage aspects related to such synchronization regardless of which type of external device (e.g. 452, 454, 456) is to be synchronized. In some examples, external device engine 460 comprises a temporal calendar function 462 by which temporal calendar information is received from an external device via wired or wireless communication per FIG. 4B and then stored and implemented on the timepiece (e.g. 50 in FIGS. 1A-1D). For instance, the temporal calendar function 462 can receive temporal calendar information from, and/or be cooperative with, an "app" or widget on a mobile phone, tablet, etc. or a fully-featured version of a program (e.g. Microsoft® Outlook®) executable on desktop computer, notebook computer, etc. As previously noted, such temporal calendar information generally comprises, but is not limited to, events having a start time and an end time, whether the events are meetings, appointments, scheduled tasks, scheduled exercise, scheduled transportation, scheduled drive time, etc. and whether the events are automatically or manually created and whether the events are automatically or manually updated.

In some examples, external device engine 460 comprises non-calendar criteria function 464 by which non-calendar criteria is received and causes an adjustment in a scheduled event, such as adjustment in the start time and/or end time per dynamic event function 430 (FIG. 5). For instance, the non-calendar criteria can be an external single event (e.g. news that school was canceled, concert canceled or rescheduled, etc.) or on-going event, such as traffic, which may impact a scheduled event, such as scheduled transportation (e.g. driving to a destination, airplane departure/arrival, etc.). In some instances, the non-calendar criteria can be information such as exercise goals (e.g. number of miles left to run this week, number of laps left to complete for weekly goal, etc.) such that an event (e.g. workout) for a particular day is automatically lengthened or shortened as displayed on timepiece 50. The event can be automatically adjusted via changing the start time, end time, or both.

Because the non-calendar criteria can include information that continues to vary, such as traffic, in some examples the timepiece 50 may be updated periodically according to this information such that adjustments to a start time and/or end time may occur multiple times, and adjustments may be ongoing even after the event starts.

In some examples, the external device engine 460 of synchronization engine 460 comprises an on-board sensor function 466 to receive information from an on-board sensor of the external device, which may be used to adjust temporal calendar information displayed via the timepiece. In some examples, such sensor information might include acoustic information, accelerometer information, etc. which may indicate whether the user of the external device is sleeping or physically active, which may in turn be used to adjust temporal calendar information such as a start time, duration, and/or end time of an event displayed via the timepiece.

In a similar manner, a received sensor information function 468 may make similar adjustments to a displayed event on the timepiece according to information sensed externally from the external device, but received by the external device (e.g. mobile phone, etc.).

In some examples, as noted, timepiece 50 may include at least engine 400 (or portions thereof) which may be any combination of hardware and programming to implement the functionalities of the engines described herein. In examples described herein, such combinations of hardware and programming may be implemented in a number of different ways. For example, the programming for the engines may be processor executable instructions stored on at least one non-transitory machine-readable storage medium and the hardware for the engine 400 may include at least one processing resource to execute those instructions. In some examples, the hardware may also include other electronic circuitry to at least partially implement engine 400. In some examples, the at least one machine-readable storage medium may store instructions that, when executed by the at least one processing resource, at least partially implement engine 400. In such examples, timepiece 50 may include the at least one machine-readable storage medium storing the instructions and the at least one processing resource to execute the instructions. In some examples, the functionalities of any engines of timepiece 50 may be at least partially implemented in the form of electronic circuitry.

In some examples, the operation and/or functionality of engine 400 and any other engines of timepiece 50 are implemented via and/or controllable via at least some aspects of control portion 301 as described in association with at least FIG. 3A.

Figure 6A:
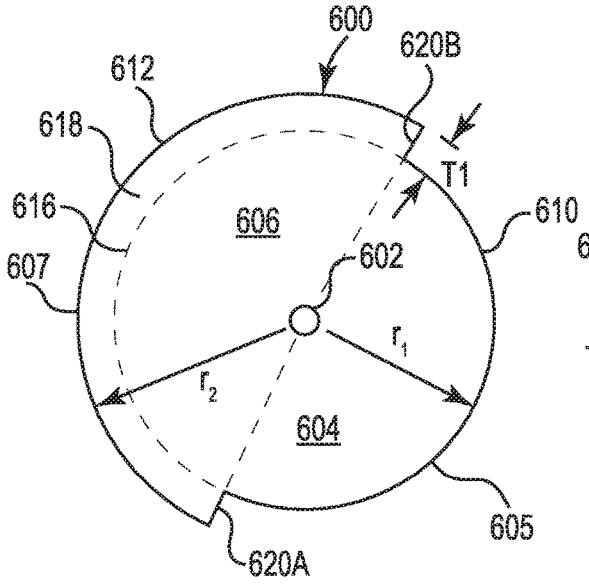
FIGS. 6A-6B are each a top view schematically representing temporal calendar mechanical elements of a timepiece, according to one example of the present disclosure.
Figure 6B:
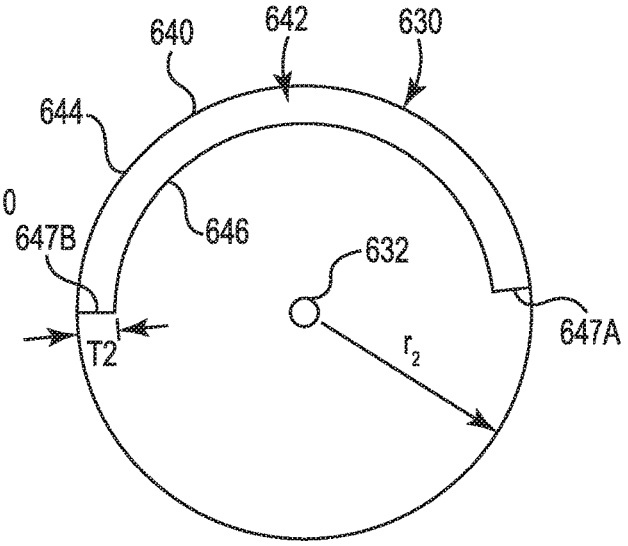

FIGS. 6A-6B are each a top view schematically representing temporal calendar mechanical elements of a timepiece, according to one example of the present disclosure. FIGS. 6A-6B depicts discs 600, 630 which serve as temporal calendar mechanical elements, and which may be substituted for discs 210, 212 and 214 in the timepiece assembly 200 in FIG. 2.

As shown in FIG. 6A, disc 600 comprises a generally circular shape with a protruding semi-circular shaped segment 618, which serves a temporal calendar indicator. In particular, disc 600 comprises a center 602 for electromechanical coupling to driver 250 (FIG. 2) and a first portion 604 with outer edge 605 and an opposite second portion 606 with outer edge 607. Each of the respective first portion 605 and second portion 606 generally define a semi-circular shape First outer edge 604 is defined by a first radius (r1) while second outer edge 607 is defined by a second radius (r2) larger than the first radius. Because of its larger second radius, second portion 606 includes the protruding segment 618 defined by outer edge 607 and a line 616 corresponding to the first radius (r1). Protruding segment 618 has a radial thickness (T1). The protruding segment 618 functions as a temporal calendar indicator, when used in conjunction with a cooperating element of disc 630, as further described in association with FIGS. 6A-6D. As further shown in FIG. 6A, protruding segment 618 includes a first end 620A and an opposite second end 620B.

As shown in FIG. 6B, disc 630 has a generally circular shape including a marked segment 642, which may serve as a temporal calendar indicator. Disc 630 comprises an outer edge 640 defining a radius (r2) matching the second radius (r2) of disc 600 in FIG. 6A. Marked segment 642 comprises a portion of disc 630 which is visibly distinguishable from the remaining portion 643 of disc 630, such as via color, texture, pattern, or combinations thereof. Marked segment 642 defines an arc having a generally semi-circular shape generally corresponding to the same size and shape of the protruding segment 618 of disc 600. As shown in FIG. 6A, marked segment 642 includes an outer edge 644 in common with outer edge 640 of disc 630 and an inner edge 646 to define a radial thickness as represented by T2, and which is generally the same as radial thickness T1 of protruding segment 618. Marked segment 642 also has a first end 647A and an opposite second end 647B.

Figure 6C:
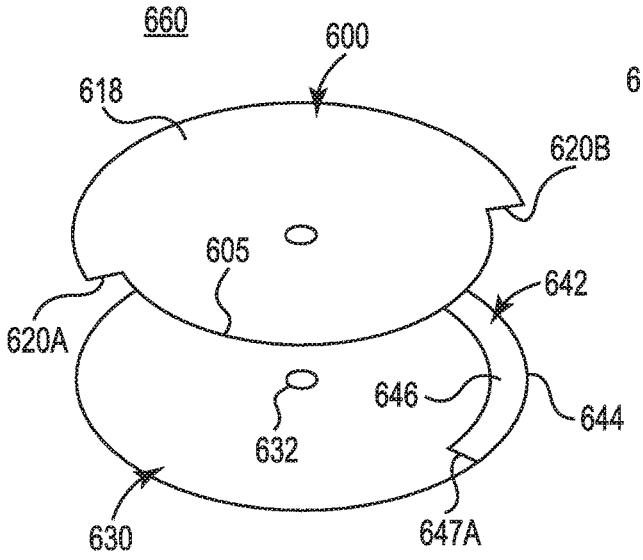
FIG. 6C is an exploded view schematically representing temporal calendar mechanical elements, according to one example of the present disclosure.

FIG. 6C is an exploded view schematically representing a juxtaposition of discs 600, 630, according to one example of the present disclosure. As shown in FIG. 6C, disc 600 is placed in a vertically stacked position layered over disc 630 in a manner similar to which disc 212 is layered over disc 214 in FIG. 2, with centers 602 and 632 aligned for coupling relative to shaft assembly 252 (FIG. 2). Discs 600 and 630 are constructed via appropriate vertical spacing, materials, rigidity, etc. to facilitate smooth rotation relative to each other.

Figure 6D:
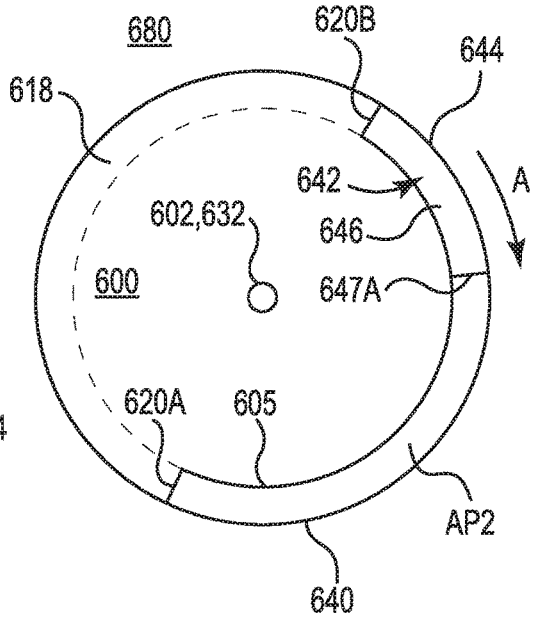
FIG. 6D is a top view schematically representing some aspects of interaction of temporal calendar mechanical elements, according to one example of the present disclosure.

FIG. 6D is a top view schematically representing discs 600, 630 cooperating together to provide temporal calendar information on a timepiece, according to one example of the present disclosure. As shown in FIG. 6D, upon relative rotation of discs 600, 630, the protruding segment 618 and marked segment 642 are movable relative to each other along a common annular path AP2. To the extent that the protruding segment 618 overlaps a portion of marked segment 642, the remaining exposed portion of marked segment 642 indicates non-expired event information. In some instances, the exposed portions of marked segment 642 may be an entire event while in some instances, the exposed portions of marked segment may comprise a portion of an event.

With further reference to FIG. 6D, a first end 647A of marked segment 642 (of disc 630) may define an end indicator for an event while the second end 620B of protruding segment 618 (of disc 600) may define a start indicator for the event before the event commences or may indicate the state (e.g. midportion) of an ongoing meeting after the event has commenced. Upon rotation of protruding segment 618 relative to temporarily fixed marked segment 642 (as represented via directional arrow A), progression of an event is displayed on a timepiece 50 during such rotation until second end 620B of protruding segment 618 passes by and over first end 647A of marked segment 642 to indicate that the event has ended.

It will be understood that, in some examples event information may be expressed via temporarily fixing the position of marked segment 642 and moving protruding segment 618, or via moving both marked segment 642 and protruding segment 618 relative to each other.

It will be understood that in some examples, instead of disc 600 using a segment 618 physically protruding outward relative to a first radius (r1), an equivalent arrangement can be achieved via a disc having a uniform radius defining its outer edge but with one outer portion including a transparent arc segment that generally matches the size and shape of the segment 618. Accordingly, upon relative movement of disc 600 and 630 as shown in FIG. 6D, portions of marked segment 642 would be exposed when the transparent arc segment of disc 600 passes over the marked segment 642.

Figure 7C:
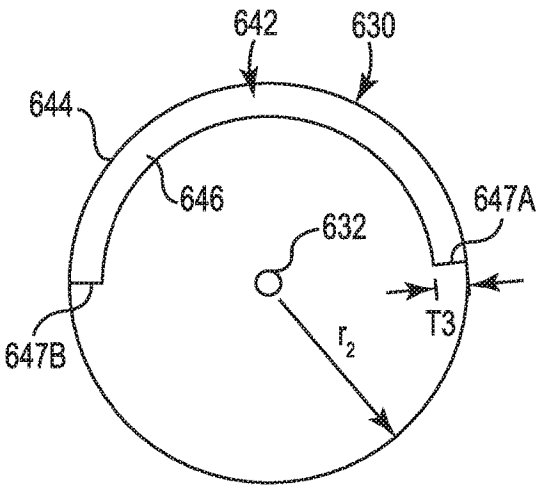
FIGS. 7A-7C are each a top view schematically representing temporal calendar mechanical elements of a timepiece, according to one example of the present disclosure.
Figure 7B:
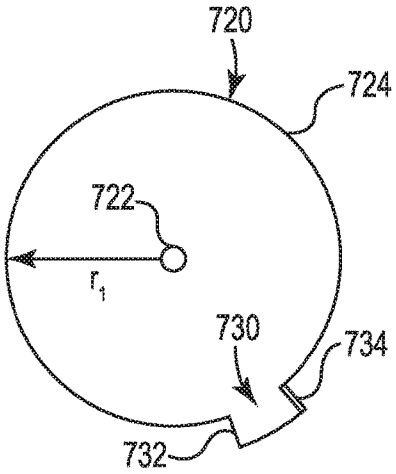
Figure 7A:
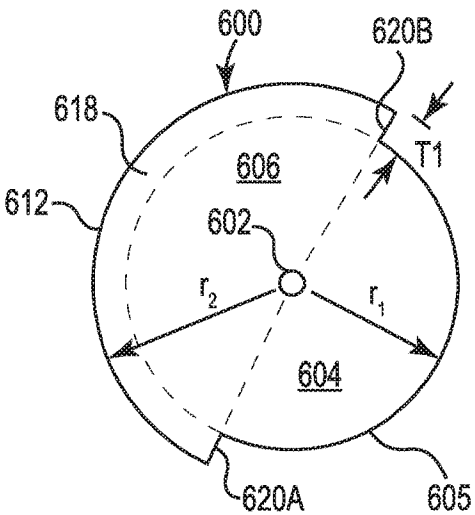

FIGS. 7A-7C are each a top view schematically representing temporal calendar mechanical elements of a timepiece, according to one example of the present disclosure. FIGS. 7A-7C depicts discs 600, 720, 630 which serve as temporal calendar mechanical elements, with disc 600 in FIG. 7A and disc 630 in FIG. 7C having the same features and attributes as previously described in FIG. 6A, 6B to provide temporal calendar information on timepiece 50. Meanwhile, disc 720 is introduced to provide a next meeting indicator 730 as further described below.

Accordingly, as shown in FIG. 7B, disc 720 has a generally circular shape according to a radius (r1) the same as first radius (r1) of disc 600 and with a protrusion 730 extending outward from an outer edge 724 of disc 720. The protrusion 730 includes a first end 734 and an opposite second end 734, and a radial thickness generally corresponding to the radial thickness (T3) of marked segment 642 of disc 630 and to the radial thickness (T1) of protruding segment 618 of disc 300, such that protrusion would move in the same annular path AP2 as those elements.

Figure 7E:
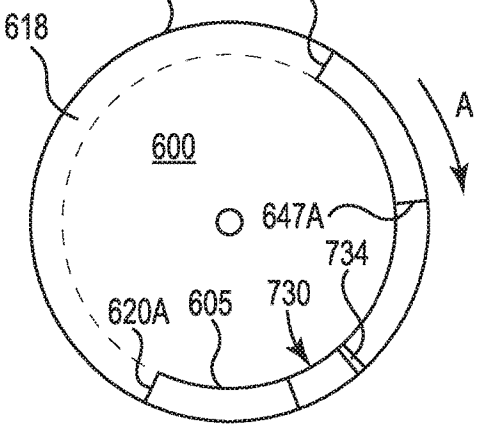
FIG. 7E is a top view schematically representing some aspects of interaction of temporal calendar mechanical elements, according to one example of the present disclosure.
Figure 7D:
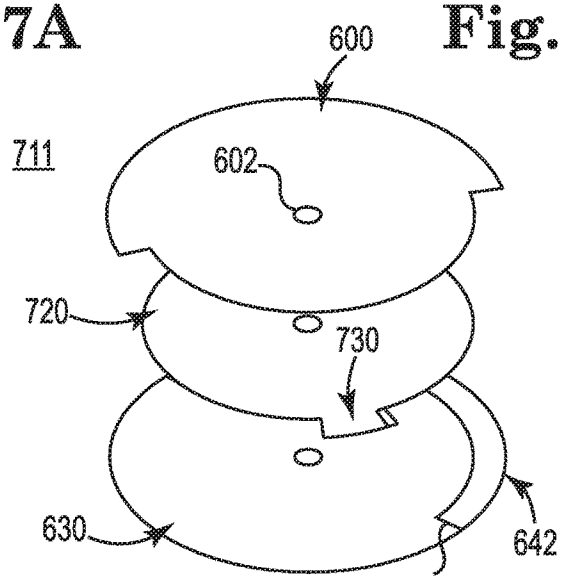
FIG. 7D is an exploded view schematically representing temporal calendar mechanical elements, according to one example of the present disclosure.

FIG. 7D is a diagram 711 including an exploded view schematically representing a juxtaposition of discs 600, 720, 630, according to one example of the present disclosure. As shown in FIG. 7D, discs 600, 630 have the same general vertically stacked relationship relative to each other (and relative to driver 250 in FIG. 2) as described in association with FIG. 6C, except with disc 720 sandwiched between discs 600 and 630.

FIG. 7E is a top view schematically representing discs 600, 720, 630 cooperating together to provide temporal calendar information on a timepiece, according to one example of the present disclosure. In the example of FIG. 7E marked segment 642 and protruding segment 618 cooperate in the manner described in association with FIG. 6D to provide temporal calendar information but with the addition of next event indicator 730. In particular, disc 720 is positioned with its first edge 734 at time corresponding to a start time of a next event to occur after the event being presently indicated by the relative positions and/or movement of marked segment 642 and protruding segment 618. In some examples, the first end 734 of protrusion 730 may have a marking, such as color, texture, pattern etc. to make first end 734 visibly conspicuous or distinguishable relative to at least unmarked portions of disc 630.

In some examples, the next event indicator 730 as implemented in the example of FIG. 7E may generally provide the same function as indicator 102 as depicted in FIG. 1C when indicator 102 is advanced forward (while a first event is in progress) in order to set a position corresponding to a start time of a next event. If there is no next event, then the next event indicator 730 may be hidden under protrusion 618. In some instances, the next event indicator 730 also can be positioned to cover the end time indicator (e.g. edge 647A of disc 630). In this arrangement, the next event indicator 730 is not also used to show a next event, but rather serves to show that the current event end time is either uncertain or is too far in the future to be shown.

FIGS. 8A-8D are each a top view schematically representing an array of discs for providing temporal calendar information to be displayed on a timepiece, according to one example of the present disclosure.

FIGS. 8A-8D depicts discs 600, 780, 800, 630, which serve as temporal calendar mechanical elements. Disc 600 in FIG. 8A and disc 630 in FIG. 8C comprise substantially the same features and attributes as previously described in FIG. 6A, 6B to provide temporal calendar information on timepiece 50. Meanwhile, discs 780 and 800 are introduced to provide the capability of showing two events as shown in FIG. 8F, as further described below.

As shown in FIG. 8B, a disc 780 comprises at least substantially the same features and attributes as disc 600 except with its protruding segment 782 exhibiting marking, such as color, texture, and/or pattern so as to be visibly conspicuous and distinguishable from the remainder of disc 780, distinguishable from protruding segment 618, and distinguishable from protruding segment 818 of disc 800 in FIG. 8C. As shown in FIG. 8B, disc 780 includes a center 781, a first semi-circular portion 790 having an outer edge 793 and a second semi-circular portion 791 having an outer edge 784, which also defines an outer edge of marked protruding segment 782. Marked protruding segment 782 comprises a generally semi-circularly shaped portion forming an arc between outer edge 784 and inner edge 786, and also includes a first end 787A and an opposite second end 787B.

As shown in FIG. 8C, disc 800 comprises substantially the same features as disc 600. However, FIG. 8C provides different reference numerals so that during cooperation of the respective discs as shown in FIGS. 8E-8F, the two discs 600, 800 can be distinguished from each other. Accordingly, as shown in FIG. 8C, disc 800 comprises a generally circular shape with a protruding semi-circular shaped segment 818, which serves a temporal calendar indicator. In particular, disc 800 comprises a center 802 for electromechanical coupling to driver 250 (FIG. 2) and a first portion 804 with outer edge 805 and an opposite second portion 806 with outer edge 807. Each of the respective first portion 604 and second portion 606 generally define a semi-circular shape First outer edge 805 is defined by a first radius (r1) while second outer edge 807 is defined by a second radius (r2) larger than the first radius. Because of its larger second radius, second portion 806 includes the protruding segment 818 defined by outer edge 807 and a line 816 corresponding to the first radius (r1). The protruding segment 818 functions as a temporal calendar indicator, when used in conjunction with a cooperating element of discs 600, 630, 780 as further described in association with FIGS. 8E-8D.

FIG. 8E is an exploded view schematically representing temporal calendar mechanical elements of a timepiece, according to one example of the present disclosure. As shown in FIG. 8E, discs 600, 630 have the same general vertically stacked relationship relative to each other and relative to driver as described in association with FIG. 6C, except with discs 780, 800 sandwiched between discs 600 and 630.

FIG. 8F is a top view schematically representing discs 600, 720, 800, 630 cooperating together to provide temporal calendar information on a timepiece, according to one example of the present disclosure. In the example of FIG. 8F, marked segment 642 and protruding segment 618 cooperate in the manner described in association with FIG. 6D to provide temporal calendar information but with the addition of marked protruding segment 782 of disc 780 and protruding segment 818 of disc 800.

As shown in FIG. 8F, upon relative rotation of discs 600, 780, 800, 630, the protruding segment 618, marked protruding segment 782, protruding segment 818, and marked segment 642 are movable relative to each other along an annular path AP2. As the protruding segment 618 partially overlaps a portion of marked segment 642, the remaining exposed portion of marked segment 642 indicates non-expired event information. In some instances, the exposed portions of marked segment 642 may be an entire event while in some instances, the exposed portions of marked segment may comprise a portion of an event after the event has already started.

With further reference to FIG. 8F, a first end 647A of marked segment 642 (of disc 630) may define an end indicator for the event while the edge 620B of protruding segment 618 (of disc 600) may define an start indicator for the event before the event commences or may indicate the state (e.g. midportion) of an ongoing meeting after the event has commenced. Upon rotation of protruding segment 618 relative to temporarily fixed marked segment 642 (as represented via directional arrow A), progression of an event is displayed on a timepiece 50 during such rotation until second end 620B of protruding segment 618 passes by and over first end 647A of marked segment 642 to indicate that the event has ended.

It will be understood that, in some examples event information may be expressed via temporarily fixing the position of marked segment 642 and moving protruding segment 618, or via moving both marked segment 642 and protruding segment 618 relative to each other.

As further shown in FIG. 8F, arrangement can display a second event simultaneously with the first event described above. In particular, as the protruding segment 818 partially overlaps a portion of protruding marked segment 782, the remaining exposed portion of protruding marked segment 782 indicates non-expired event information. In some instances, the exposed portions of protruding marked segment 782 may be an entire event while in some instances, the exposed portions of protruding marked segment 782 may comprise a portion of an event after the event has already started. However, in FIG. 8F, this arrangement would indicate an entire event because the marked segment 642

(relative to protruding segment 618) indicates an earlier event which has not been completed.

With further reference to FIG. 8F, a first end 820A of protruding segment 818 (of disc 800) may define an end indicator for the second event while the second end 787B of marked protruding segment 782 (of disc 780) may define a start indicator for the event before the event commences or may indicate the state (e.g. midportion) of an ongoing meeting after the event has commenced (at least if the earlier event were completed). Upon rotation of marked protruding segment 782 relative to temporarily fixed protruding segment 818 (as represented via directional arrow B), progression of an event is displayed on a timepiece 50 during such rotation until second end 787B of marked segment 782 passes by and underneath first end 820A of protruding segment 818 to indicate that the event has ended.

In some examples, instead of representing two different events, the respective protruding segments 618 and 818, marked protruding segment 782, and marked segment 630 cooperate together via rotational positioning and movement along the same annular path to represent a single event having a longer duration which would otherwise could not be suitably represented by just one of the marked protruding segment 782 and marked segment 630.

It will be understood that, in some examples event information may be expressed via temporarily fixing the position of marked protruding segment 782 and moving protruding segment 818, or via moving both marked protruding segment 742 and protruding segment 818 relative to each other.

As previously mentioned in association with FIGS. 6A-6D, it will be understood that in some examples, various combinations of protruding segments, marked portions, and combinations thereof, as well as the use of transparent segments can be used to depict a start time, end time, next event, and progression of an event.

Figure 9:
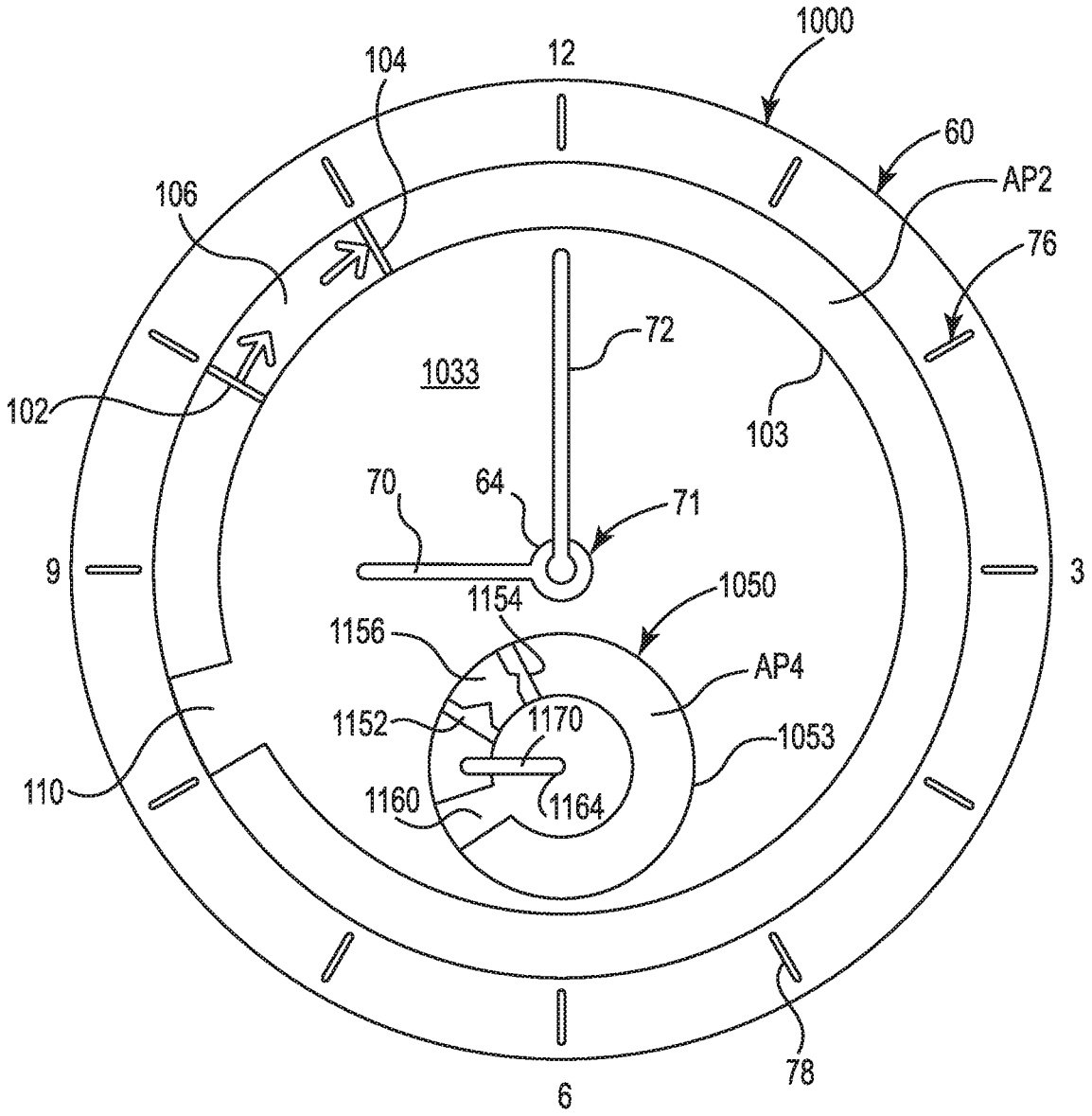
FIG. 9 is a top view schematically representing a temporal calendar mechanical arrangement nested within a timepiece, according to one example of the present disclosure.

FIG. 9 is a top view schematically representing a second timepiece 1050 nested within a first timepiece 1000, according to one example of the present disclosure. In some examples, timepiece 1000 comprises at least some of substantially the same features and attributes as timepiece 50 in FIG. 1A, except having a second timepiece 1050 nested within an interior area 1033 of timepiece 1000 and located at a position to be non-concentrically arranged relative to the dial 60 of first timepiece 1000.

In some examples, the second timepiece 1050 comprises at least some of substantially the same features and attributes as first timepiece 50 in FIG. 1A. In some examples, timepiece 1050 omits a minute hand. Accordingly, as shown in FIG. 9, timepiece 1050 comprises a generally circular outer border 1053 and a center 1164. In general terms, timepiece 1050 defines an annular path AP4 along which various elements selectively travel to display temporal calendar information. In some examples, such elements include an event start indicator 1152, an event end indicator 1154, and an event duration 1156 between the movable indicators 1152, 1154. These elements comprise at least some of substantially the same features and attributes as the respective start indicator 102, end indicator 104, and duration 106 as described in association with at least FIGS. 1A-1D and 2.

It will be understood that, in at least some examples, wherein the location or axis about which at least one of the temporal calendar indicators rotate is spaced apart and inward from the first dial 60. Stated differently, the rotational axis is located within the interior area 1033 of the first timepiece 1000 and is not located at an outer edge defined by dial 60.

In some examples, timepiece 1050 comprise an hour hand 1170 and tab 1160 (e.g. hour follower tab), with each having at least some of substantially the same features and attributes as hour hand 60 and tab 110 in FIGS. 1A-1D and 2.

In some examples, the second timepiece 1050 displays temporal calendar information (e.g. events) independently from first timepiece 1000. This arrangement enables tracking temporal calendar information for one person (e.g. parent) on first timepiece 1000 and tracking temporal calendar information for a second person (e.g. child) on the nested, second timepiece 1050. In some examples, the temporal calendar information displayed on first timepiece 1000 is interrelated with and/or cooperates with the temporal calendar information displayed on second timepiece 1050. In some examples, both timepieces 1000, 1050 display and track temporal calendar information for a single entity (e.g. single person or organization) with each respective timepiece 1000, 1050 being dedicated for different purposes, such as one for work events and the other timepiece for personal events.

In some examples, timepiece 1000 omits a temporal calendar arrangement (e.g. start indicator 102, end indicator 104, tab 110, etc.) while still retaining the hour hand 70 and minute hand 72 which are rotatable about center 64 to display time-of-day information. Accordingly, in this example, timepiece 1050 would be the sole timepiece for displaying temporal calendar information in accordance with the examples of the present disclosure.

Figure 10:
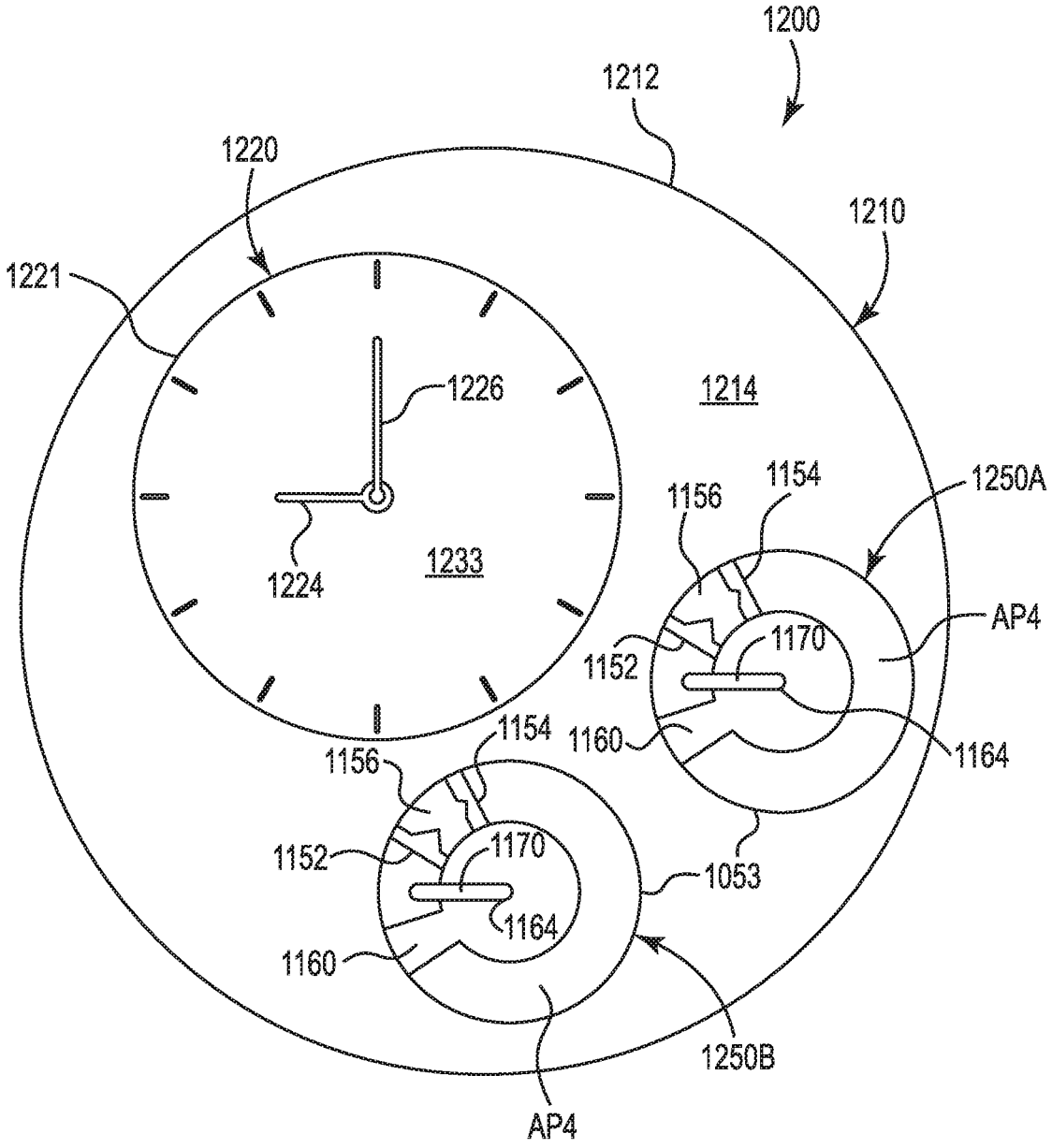
FIG. 10 is a top view schematically representing a device including pair of separate temporal calendar mechanical arrangements relative to a timepiece, according to one example of the present disclosure.

FIG. 10 is a top view schematically representing a device 1200 including multiple timepieces 1220, 1250A, 1250B nested within a common frame 1210, according to one example of the present disclosure. As shown in FIG. 10, frame 1210 comprises a generally circular member having an outer edge 1212 defining an interior area 1214. Timepiece 1220 is nested within interior area 1214 and has a diameter such that enough space remains within the interior area 1214 of frame 1210 to also host timepieces 1250A, 1250B. Accordingly, timepieces 1250A, 1250B are not nested within an interior area 1233 of timepiece 1220.

In some examples, timepiece 1220 includes a dial 1222 with hourly time markings and forming a generally circular shape defined via outer edge 1221. Timepiece 1220 also includes an hour hand 1224 and a minute hand 1226 to keep time in a customary manner.

However, each timepiece 1250A, 1250B displays and tracks temporal calendar information, such as information regarding events. Such information may be a start time, an end time, and a duration of an event.

In some examples, each timepiece 1250A, 1250B comprises at least some of substantially the same features and attributes as timepiece 1050 in FIG. 9.

However, in some examples, at least one of the timepieces 1250A, 1250B comprise at least some features and attributes different from timepiece 1050. For instance, at least one of timepieces 1250A, 1250B may have a different arrangement (than timepiece 1050) for providing the start indicator, end indicator, etc. such as implementing one of the arrangements as previously described in association with FIGS. 6A-6D, FIGS. 7A-7E, or FIGS. 8A-8F.

While timepiece 1250A shows the various indicators as having generally the same position as timepiece 1250B for illustrative simplicity, it will be understood that timepiece 1250A may display and track temporal calendar information independently from timepiece 1250B such that the indicators for one timepiece 1250A are typically in different positions than the indicators for the other timepiece 1250B.

This arrangement enables tracking temporal calendar information for one person (e.g. parent) on first timepiece 1000 and tracking temporal calendar information for a second person (e.g. child) on the nested, second timepiece 1050. In some examples, the temporal calendar information displayed on first timepiece 1000 is interrelated with and/or cooperates with the temporal calendar information displayed on second timepiece 1050. In some examples, both timepieces 1000, 1050 display and track temporal calendar information for a single entity (e.g. single person, single family, single organization) with each respective timepiece 1000, 1050 being dedicated for different purposes, such as one for work events and the other timepiece for personal events.

Moreover, in some examples, one timepiece 1250A can have a different indicator arrangement than the other timepiece 1250B. Like timepiece 1150 in FIG. 9, any one of the different indicator arrangements as described in association with FIGS. 6A-6D, 7A-7E, and 8A-8F may be used instead of the indicator arrangement shown for timepieces 1250A, 1250B in FIG. 10.

As shown in FIG. 10, the hour hand 1170 of each timepiece 1250A, 1250B is synchronized to display the same time-of-day (e.g. 9 o'clock) as the hour hand 1224 of timepiece 1220.

Figure 11:
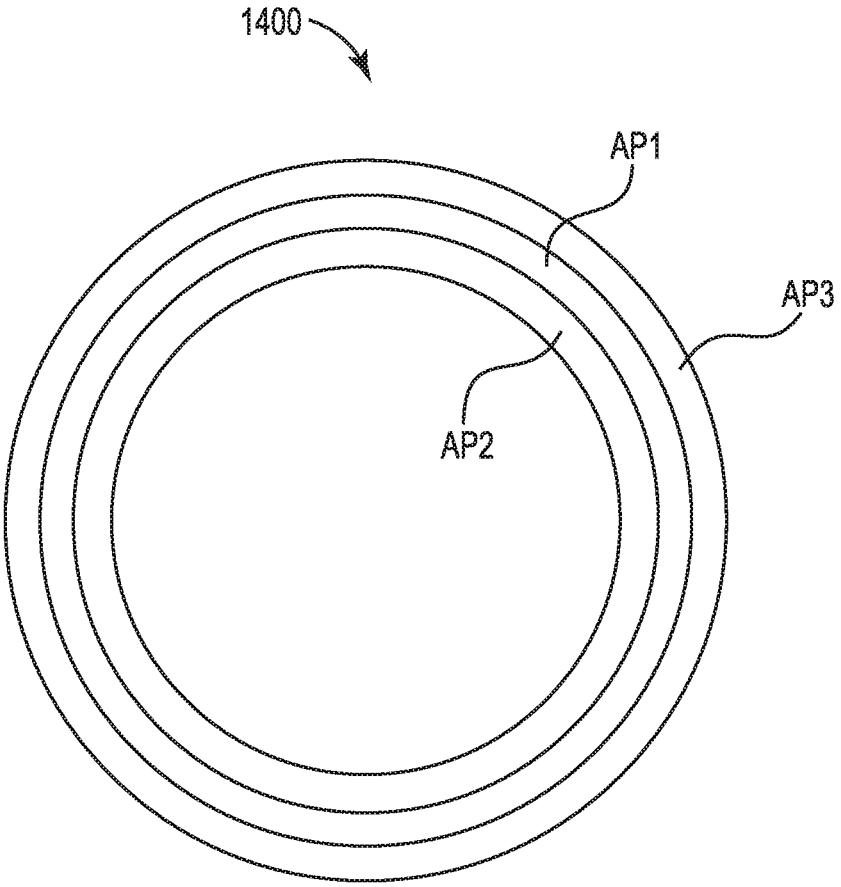
FIG. 11 is a top view schematically representing an arrangement of annular paths for a timepiece, according to one example of the present disclosure.

FIG. 11 is a top view schematically representing an arrangement 1400 of annular paths 1401, 1410, 1412 for displaying temporal calendar information on a timepiece, according to one example of the present disclosure. In some examples, the arrangement 1400 utilizes any one of the various arrangements previously described in association with at least FIGS. 1A-1D, FIGS. 6A-6D, FIGS. 7A-7E, and FIGS. 8A-8F. Whereas at least some earlier examples (at least FIG. 1A) provide for a concentric relationship in which a second annular path AP2 is nested within first annular path AP1, in some examples this relationship can be switched so that first annular path AP1 is nested within second annular path AP2.

In some examples, as shown in FIG. 11, a third annular path AP3 is introduced for display and rotational movement of temporal calendar mechanical elements to exhibit temporal calendar information independent from and/or in cooperation with the temporal calendar information exhibited on first annular path AP1. In this arrangement, second annular path AP2, which may provide a dial for timekeeping, is sandwiched between the first and third annular paths AP1, AP3 and concentrically arranged therein.

In some examples, other variations may be used such as having the timekeeping dial arranged along the most interior annular path AP1 and having the outer two annular paths AP2, AP3 used for displaying temporal calendar information in accordance with the examples of the present disclosure.

Figure 12:
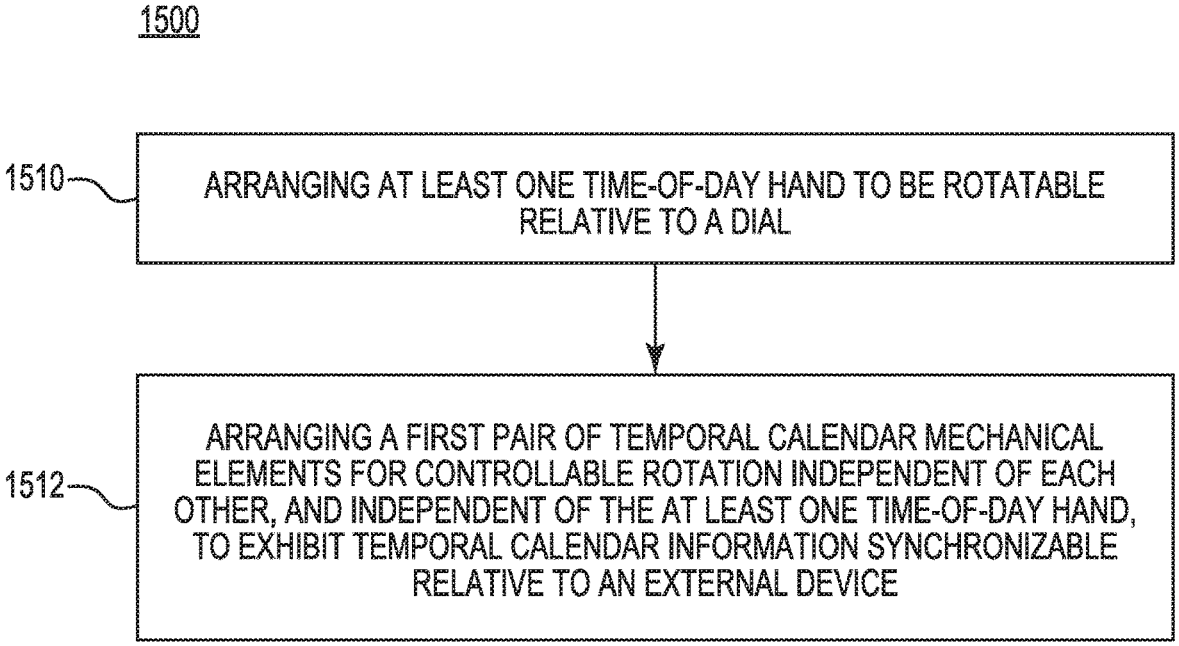
FIG. 12 is flow diagram schematically representing a method of manufacturing, according to one example of the present disclosure.

FIG. 12 is flow diagram schematically representing a method 1500 of manufacturing, according to one example of the present disclosure. In some examples, method 1500 is performed via at least some of the timepieces, assemblies, engines, control portions, functions, parameters as previously described in association with FIGS. 1-11. In some examples, method 1500 is performed via at least some timepieces, assemblies, engines, control portions, functions, parameters other than those previously described in association with FIGS. 1-11.

In some examples, at 1510 method 1500 comprises arranging at least one time-of-day hand to be rotatable relative to a dial. At 1512, method 1500 comprises arranging a first pair of temporal calendar mechanical elements for controllable rotation independent of each other, and independent of the at least one time-of-day hand, to exhibit temporal calendar information synchronizable relative to an external device.

Figure 13:
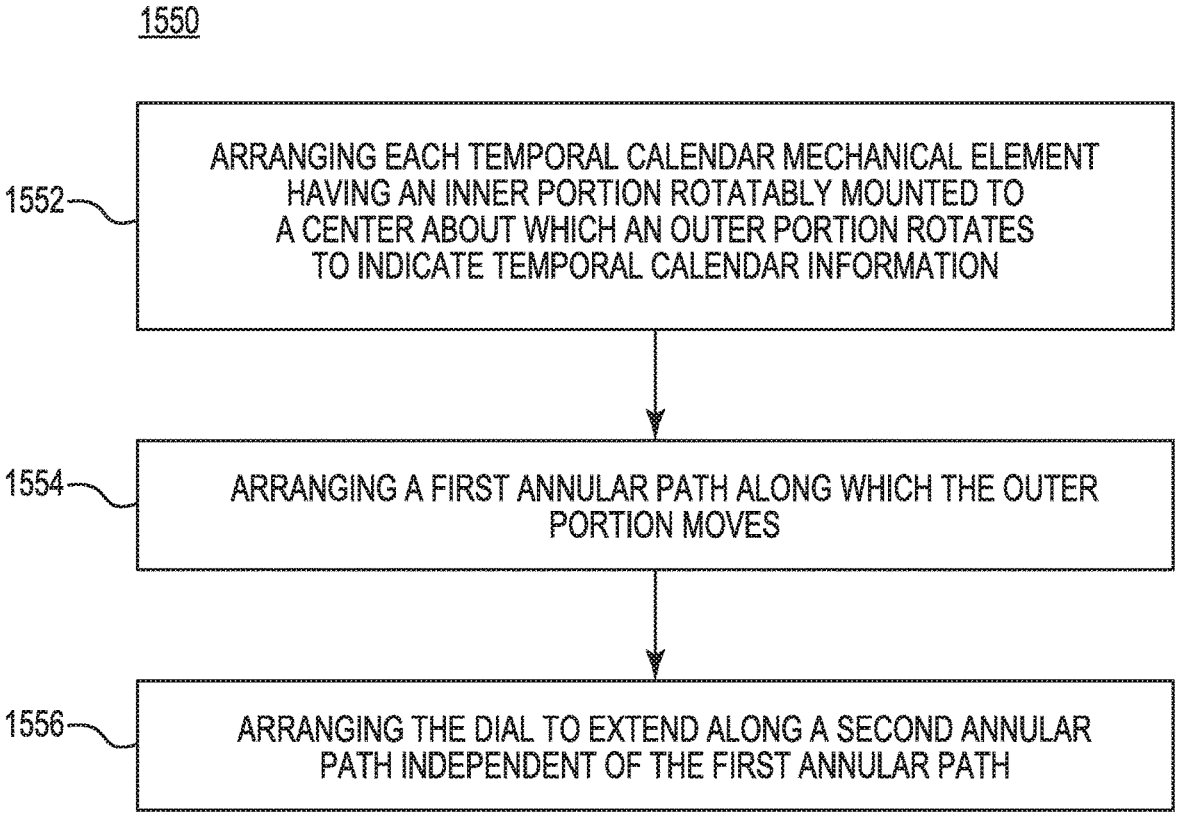
FIG. 13 is flow diagram schematically representing a method of manufacturing, according to one example of the present disclosure.

FIG. 13 is flow diagram schematically representing a method of manufacturing, according to one example of the present disclosure. In some examples, method 1550 is performed via at least some of the timepieces, assemblies, engines, control portions, functions, parameters, as previously described in association with FIGS. 1-11. In some examples, method 1550 is performed via at least some timepieces, assemblies, engines, control portions, functions, parameters other than those previously described in association with FIGS. 1-11.

In some examples, method 1550 is performed in cooperation with method 1500 in FIG. 12.

As shown in FIG. 13, at 1552 method 1550 comprises arranging each temporal calendar mechanical element having an inner portion rotatably mounted to a center about which outer portion rotates to indicate temporal calendar information.

At 1554, method 1550 comprises arranging a first annular path along which the outer portion moves, and at 1556, method 1550 comprises arranging the dial to extend along a second annular path independent of the first annular path.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A timepiece comprising:

at least one time-of-day hand rotatable relative to a first dial; and a first pair of temporal calendar mechanical elements independently rotatable relative to each other to exhibit temporal calendar information, wherein controlled rotation of the respective temporal calendar mechanical elements is electromechanically independent of the at least one time-of-day hand and is synchronizable relative to temporal calendar information on an external device, wherein each respective temporal calendar mechanical element comprises a disc including an outer edge portion with a calendar parameter indicator, wherein relative movement of the two respective calendar parameter indicators, via relative movement of the two discs, is used to track at least a beginning and an end of an event.

2. The timepiece of claim 1, wherein the at least one time-of-day hand is rotatable relative to a center of the first dial.

3. The timepiece of claim 2, comprising:

a second dial including a center about which the first pair of temporal calendar mechanical elements are rotatable, wherein the second dial is nested within a circumference of the first dial and is positioned at a non-center location of the first dial.

4. The timepiece of claim 3, a third dial at a non-center location of the first dial with the third dial including a center, the third dial positioned nested within a circumference of the first dial; and a second pair of temporal calendar mechanical elements rotatable about the center of the third dial, wherein relative rotatable movement between the first temporal calendar mechanical element and the second temporal calendar mechanical element is used to indicate temporal calendar information, and wherein rotational positioning of the second pair of temporal calendar mechanical elements is controllable independently of the first pair of temporal calendar mechanical elements and independently of the at least one time-of-day hand.

5. The timepiece of claim 1, wherein the respective temporal calendar mechanical elements are rotatable relative to a center of the first dial.

6. The timepiece of claim 1, wherein the calendar parameter indicator of the first disc comprises an arc having a first color/pattern and the calendar parameter indicator of the second disc comprises an arc having a second color/pattern, wherein relative movement between the first color/pattern and the second color/pattern is used to indicate calendar information.

7. The timepiece of claim 6, comprising:

a third disc including an outer edge portion defining a tab and rotatable independently relative to the second dial and relative to the first and second discs, and controllable to indicate at least one of:

a start of a next calendar event time; and that an end time for a calendar event cannot be displayed.

8. The timepiece of claim 1, comprising:

an hour follower tab to rotate in synchrony with an hour hand and positioned at a fixed distance relative to the hour hand corresponding to a time lag relative to the hour indicated by the hour hand, wherein the hour follower tab moves in the same annular path as the indicator of the respective temporal calendar mechanical elements.

9. An analog timepiece comprising:

at least one time-of-day mechanical element including a first portion movable along a first annular path relative to a dial; and a first pair of temporal-calendar mechanical elements movable independently from, and relative to, each other along a second annular path to indicate temporal calendar information relative to the dial, wherein the temporal calendar mechanical elements are electromechanically controlled independently of the at least one time-of-day mechanical element and are synchronizable relative to temporal calendar information on an external timepiece, wherein each respective temporal calendar mechanical element comprises a disc including an outer edge portion with a calendar parameter indicator, wherein relative movement of the two respective calendar parameter indicators, via relative movement of the two discs, is used to track at least a beginning and an end of an event.

10. The timepiece of claim 9, wherein the respective first and second annular paths are arranged concentrically relative to each other.

11. The timepiece of claim 9, comprising:

a second pair of temporal-calendar mechanical elements movable independently from, and relative to, each other along a third annular path to indicate temporal calendar information.

12. The timepiece of claim 11, wherein the respective first, second, and third annular paths are arranged concentrically relative to each other.

13. A method of manufacturing a timepiece comprising:

arranging at least one time-of-day hand to be rotatable relative to a dial; and arranging a first pair of temporal calendar mechanical elements for controllable rotation independent of each other, and independent of the at least one time-of-day hand, to exhibit temporal calendar information synchronizable relative to an external timepiece, wherein each respective temporal calendar mechanical element comprises a disc including an outer edge portion with a calendar parameter indicator, wherein relative movement of the two respective calendar parameter indicators, via relative movement of the two discs, is used to track at least a beginning and an end of an event.

14. The method of claim 13, comprising:

arranging each temporal calendar mechanical element to include an inner portion rotatably mounted to a center about which the outer portion rotates to indicate temporal calendar information;

arranging a first annular path along which the outer portion moves; and arranging the dial to extend along a second annular path independent of the first annular path.

* * * * *